United States Patent [19]

Larsen

[11] 4,059,192

[45] Nov. 22, 1977

[54] COUPLER HEIGHT ADJUSTER FOR RAILWAY CARS

[75] Inventor: Glen D. Larsen, Upper Marlboro, Md.

[73] Assignee: Southern Railway Company, Washington, D.C.

[21] Appl. No.: 761,382

[22] Filed: Jan. 21, 1977

[51] Int. Cl.[2] ..... B61G 9/22

[52] U.S. Cl. ..... 213/61; 213/51; 213/62 R

[58] Field of Search ..... 213/20, 21, 51, 54, 213/58, 60, 61, 62 R, 62 A, 65, 67 R, 67 A, 69

[56] References Cited

U.S. PATENT DOCUMENTS

| | | | |
|---|---|---|---|
| 1,143,689 | 6/1915 | Darby | 213/60 |
| 1,419,508 | 6/1922 | Neikirk | 213/60 |
| 1,470,877 | 10/1923 | Rink | 213/60 |
| 1,619,693 | 3/1927 | Barrows | 213/61 |
| 1,931,479 | 10/1933 | Barrows | 213/60 |
| 1,963,066 | 6/1934 | Barrows | 213/60 |
| 1,989,647 | 1/1935 | Barrows | 213/60 |
| 1,991,650 | 2/1935 | Barrows | 213/61 |
| 2,271,907 | 2/1942 | Wilson | 213/60 |
| 2,565,534 | 8/1951 | Travilla, Jr. | 213/61 |
| 2,676,713 | 4/1954 | Blattner | 213/60 |
| 2,807,375 | 9/1957 | Winther | 213/61 |
| 2,812,074 | 11/1957 | Blattner | 213/61 |
| 3,610,436 | 10/1971 | Wisler | 213/21 |
| 3,827,575 | 8/1974 | Mosier et al. | 213/20 |

*Primary Examiner*—Trygve M. Blix
*Assistant Examiner*—Stuart M. Goldstein

[57] ABSTRACT

The coupler height of a railway car is adjustable by means of a shim disposed between the coupler carrier and the wear plate and inserted through an opening provided at one side of the striking casting. An enlarged central portion of the shim extends toward the draft bar yoke of the coupler to avoid any reduction of bearing surface between the coupler carrier and the wear plate. A portion of the shim also lies within the side opening, which opening is defined by an enlarged outwardly extending portion of the striking casting having holes therein in axial alignment with a hole in the shim portion for the reception of a fastener to retain the shim in place. The aligned holes are offset from the longitudinal centerline of the shim so as to effect a misalignment of the holes upon incorrect insertion of the shim. Moreover, either the upper surface of the carrier member or the lower surface of the wear plate is convexly curved for effecting a self-alignment of the coupler with a mating coupler as the wear plate is permitted to rock about its transverse axis to thereby effect a uniform interface pressure between the wear plate and the coupler.

10 Claims, 6 Drawing Figures

10
11
12
13
14
15
16
17
18
19
21
22
23
24
25
27
32
33
34
35
36
37
38
39
41

19
23
25
27
28
29
31
38
39
42

COUPLER HEIGHT ADJUSTER FOR RAILWAY CARS

BACKGROUND OF THE INVENTION

This invention relates generally to couplers for railway cars, and more particularly to a height adjuster for the coupler that is carried out with the use of a shim disposed between the coupler carrier and the carrier wear plate.

Problems in maintaining the required coupler heights have persisted over the years for the railroad industry for both new and existing railway cars. Measured from the top of the rail to the center of the face of the coupler knuckle, the American Association of Railroads (AAR) requires a minimum of 32½ inches and a maximum of 34½ inches for empty cars and a minimum of 31½ inches and a maximum of 33½ inches for loaded cars. Various approaches have been taken in attempts to comply with these standards, among these being the use of a shim secured over the coupler carrier wear plate. The coupler knuckle or face is therefore elevated a distance equal to approximately three times the thickness of the shim because of the length of the coupler draft bar. However, these coupler carrier shims are required by the AAR to be of a minimum ¼ inch thickness because of the wear to which they are subjected upon cross shifting movement of the coupler draft bar. A ¾ inch vertically upward adjustment is therefore the minimum made possible with the use of such shims.

On the other hand, shims of less than the ¼ inch minimum thickness could be inserted between the coupler carrier and the wear plate to provide for finer adjustments at the coupler knuckle. An approach taken in the past for gaining access to the shim was to remove the coupler, which is a tedious and time-consuming task, so as to provide the necessary vertical clearance to raise the wear plate above its carrier member. Also, the shim could be placed there before the coupler is installed new, but it would be a speculative approach since coupler height can vary from car to car.

In order to provide easier access for the shim between the coupler carrier and the wear plate, striking castings have heretofore been provided with front and/or side openings through which the shim may be extended after elevating the wear plate. However, these openings are typically plain openings which serve to only weaken the striking casting at that location thereby causing premature failure due to torsional, bending, fatigue and other stresses to which the casting is subjected. Such shims are, moreover, of substantially rectangular shape and therefore provide inadequate support for the coupler carrier wear plate which normally has a large center section extending toward the draft bar yoke.

OBJECTS OF THE INVENTION

It is an object of the present invention to obviate the problems encountered with past coupler adjustment techniques by providing a shim of a unique design and varying thicknesses for easy access to the area beneath the coupler wear plate and above the coupler carrier.

Another object is to provide a shim design that will hold its position even if the car is turned upside down in a rotary dumper. Also, the bottom of the coupler wear plate or the top plate of the coupler carrier has a curved surface to allow the wear plate to self-align to provide full bearing with the companion wear plate connected to the bottom of the coupler draft bar.

A further object is to provide an access opening at a side of the striking casting for insertion of the shim, the opening being defined by an enlargement of the casting for providing a structural reinforcement at the opening. Provision is also made for avoiding incorrect insertion of the shim.

Other objects, advantages and novel features of the invention will become more apparent from the following detailed description when taken in conjunction with the accompanying drawings.

DETAILED DESCRIPTION OF THE DRAWINGS

Figure 1:
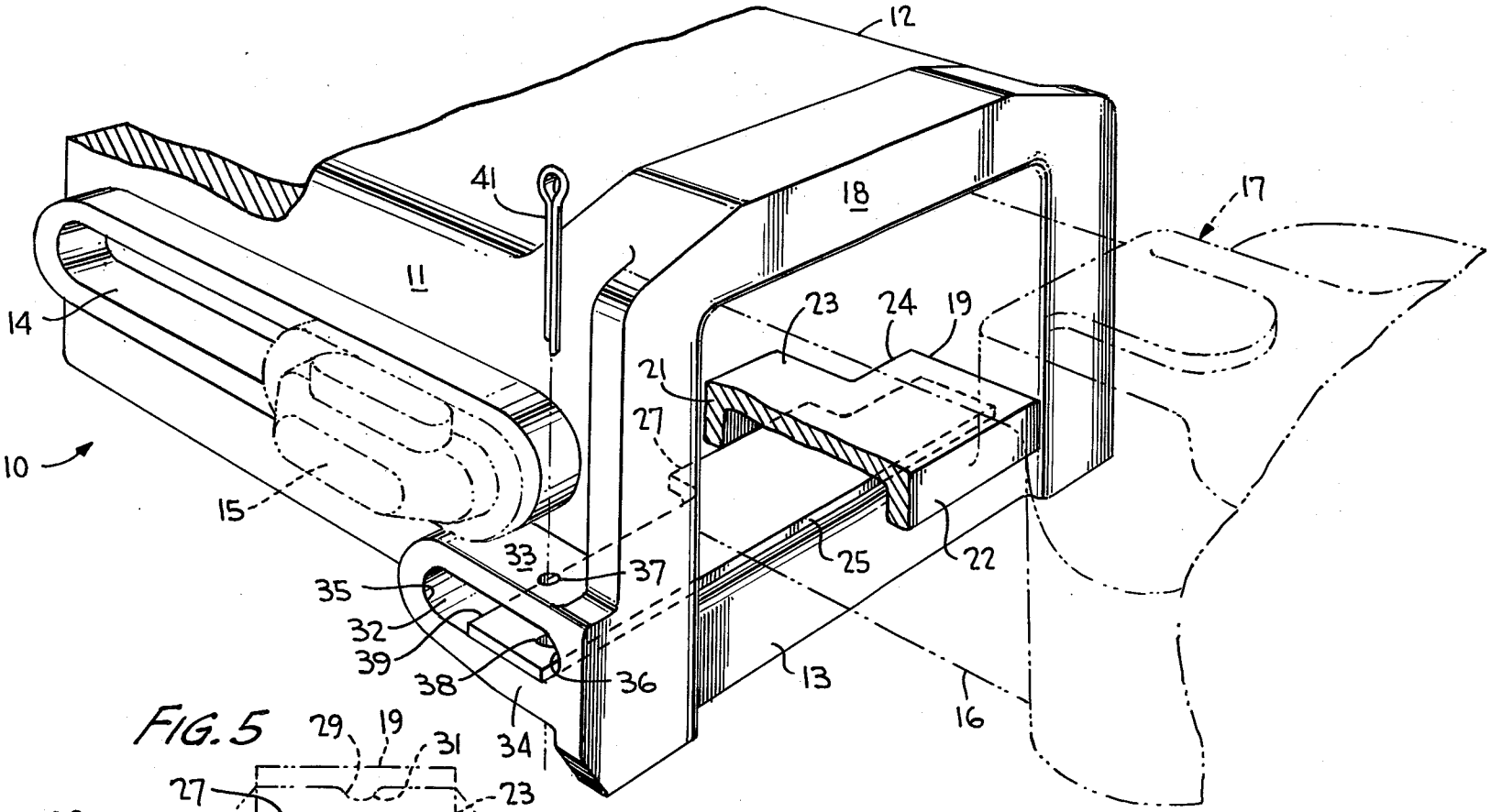
FIG. 1 is a perspective view of a striking casting modified in accordance with the invention and showing the present shim design in place beneath the coupler carrier wear plate.
Figure 2:
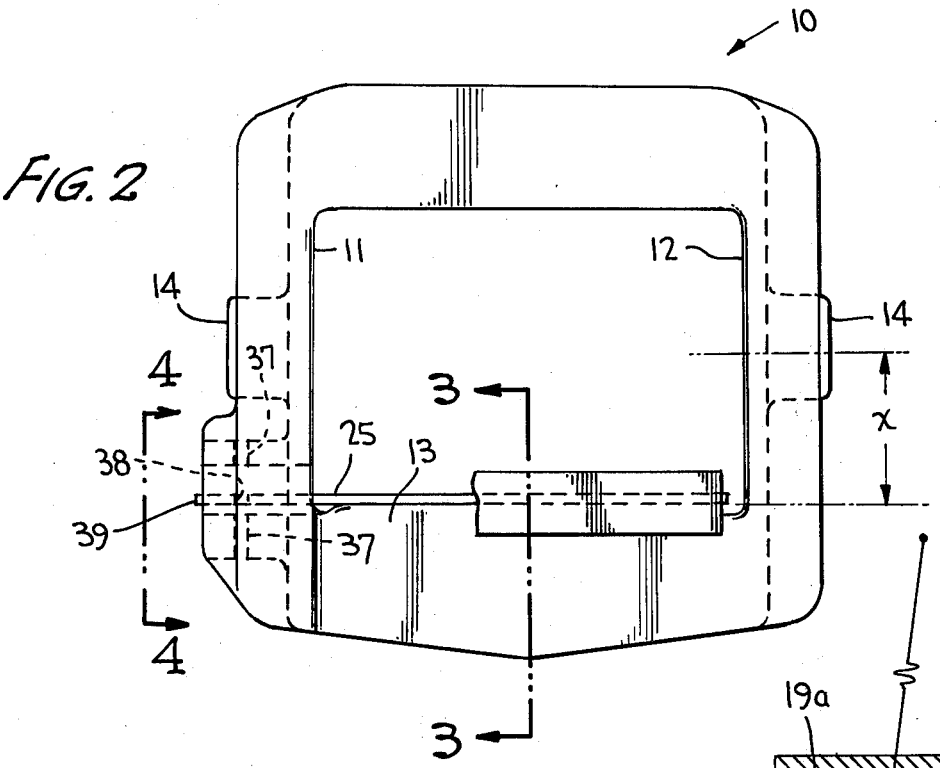
FIG. 2 is a front elevational view of the combination shown in FIG. 1.

Turning now to the drawings wherein like reference characters refer to like and corresponding parts throughout the several views, a striking casting is generally shown at 10 in FIGS. 1 and 2 as typically including transversely spaced side walls 11 and 12 and a coupler carrier 13 extending between the side walls and integrally connected therewith. Keyways or horizontally disposed slots 14 are provided in the casting sidewalls for the reception of a draft key or yoke 15 transversely disposed at an end of draft bar 16 of the coupler generally designated 17 shown in phantom outline in FIG. 1. The draft key or yoke 15 is guided within slots 14 permitting slight longitudinal movement of the coupler which is cushioned in some customary manner by means located behind the draft bar. A standard striker plate 18 is located above the draft bar and defines a top wall for the pocket through which the bar extends outwardly of the rail car. The draft bar rests on the coupler carrier member which extends therebeneath and which is covered by a wear plate 19 of a typical design. This wear plate extends between the opposite sidewalls of the striking casting and has depending flanges 21 and 22 which embrace a top portion of the coupler carrier. The wear plate is also provided with an enlarged central portion 23 extending toward the yoke and defined by cutouts 24 to provide the necessary clearances within the striking casting opening.

Figure 5:
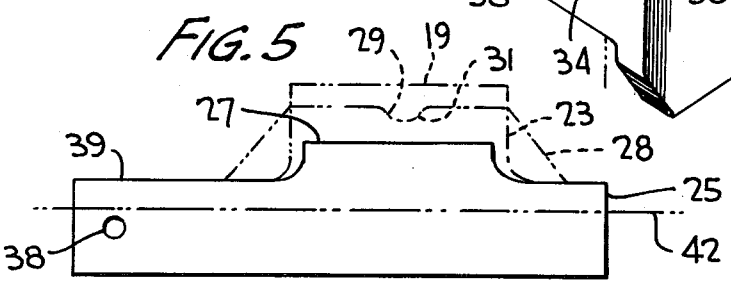
FIG. 5 is a top plan view of the shim in accordance with the invention superimposed with the coupler carrier and the wear plate shown in phantom outline.
Figure 3A:
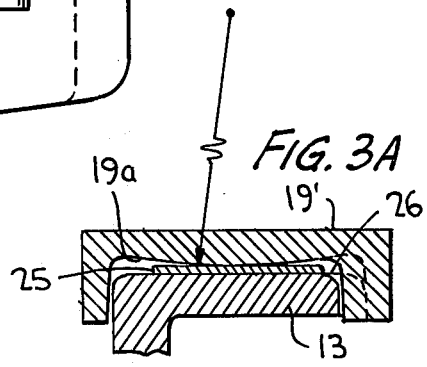
FIG. 3A is a sectional view similar to FIG. 3 of a modified flat and curved interface.

A shim 25 in the form of a flat elongated plate rests along top surface 26 (FIG. 3A) of the coupler carrier and its also provided with an enlarged central portion 27 disposed beneath portion 23 of the wear plate and likewise extending toward yoke 15 of the draft bar. The coupler carrier also has a central portion 28 over which the central portions of the shim and the wear plate lie, as shown in FIG. 5. Portion 28 of the coupler carrier is typically provided with a vertical groove 29 for the reception of a complementary projection 31 provided on the wear plate for keying the wear plate in place. As can be seen, the enlarged central portion of the shim more fully occupies the space beneath the enlarged central portion of the wear plate so as to provide an increased bearing surface between the coupler draft bar and the wear plate.

Figure 4:
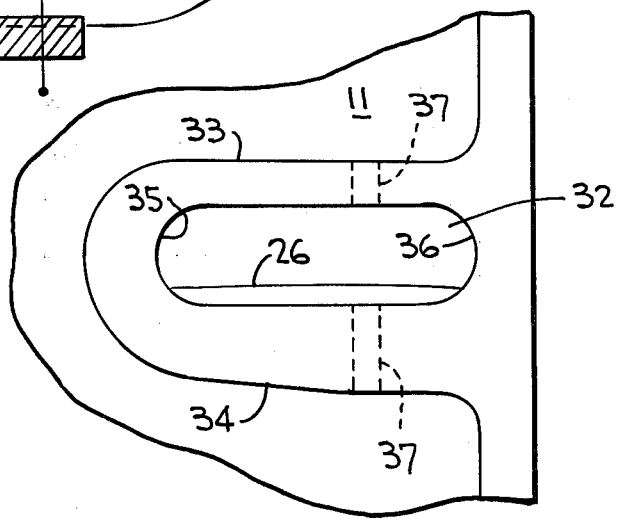
FIG. 4 is a slightly enlarged partial end view of the access opening and its structure to accommodate shim insertion, when viewed in the direction of line 4—4 of FIG. 2.

To facilitate insertion of the shim beneath the wear plate, one (FIG. 1) or both (not shown) sidewalls of the striking casting is provided with an access opening 32 of a sufficient size as to permit the full width-wise dimension of the shim to be inserted in place without obstruction. This opening (see also FIG. 4) is defined by spaced upper and lower walls 33 and 34 and concavely curved end walls 35 and 36 of radii designed to the endurance limits of the casting material and the imposed forces on the casting. The size of the access opening is of minimum dimension consistent with the size of required shim, and walls 33 to 36 extend transversely outwardly of sidewall 11 to provide the necessary reinforcing structure to resist the added bending and torsion that results from such opening in this highly stressed attachment area of the critical coupler carrier. In order to reduce stress concentration around the access opening, the inner radii of walls 35 and 36 may be designed as, for example, $\frac{5}{8}$ inch for an access opening $4\frac{1}{4}$ inches wide and $1\frac{1}{4}$ inches high. The outward extent of walls 33 and 36, for the size of such an access opening, may be approximately $2\frac{1}{4}$ inches so as to resist bending stresses of the striking casting at the access opening. Moreover, lower wall 34 is thickened relative to upper wall 33 to substantially a double thickness dimension to further reduce stress concentrations from torsional and other loads.

Currently the AAR Car Design Manual specifies a calculated force of 50,000 pounds up and down at the coupler face. This results in a force on the coupler carrier of over 150,000 pounds. It therefore becomes apparent that an access hole support structure of the present type is of vital importance to resist the added bending and torsion that results from the provision of the access opening in such a highly stressed attachment area.

Axially aligned holes 37 are provided in upper and lower walls 33 and 34 as well as in a portion 39 of the shim which extends into the access opening (see FIG. 2). A cotter pin 41 or similar type fastener may therefore be inserted through these aligned openings for anchoring the shim in place even when the car is turned upside down in a rotary dumper. Moreover, the shim portion 39 with hole 38 provides ready access to the shim with a hook tool when removal is desired.

Also, the axially aligned holes are slightly offset from a longitudinal centerline 42 of the shim (see FIG. 5) so that, should the shim be inadvertently inserted upside down through the access opening with portion 27 facing outwardly of the striking casting, hole 38 would misalign with holes 37 so that insertion of fastener 41 therethrough would be blocked.

Figure 3:
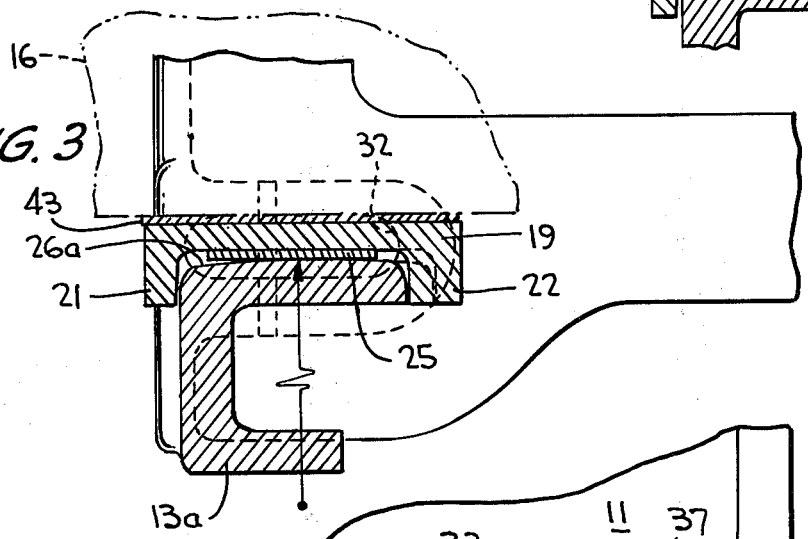
FIG. 3 is a sectional view showing the interface of a flat and a curved wear plate and coupler carrier, taken substantially along line 3—3 of FIG. 2.

In accordance with another feature of the invention, upper surface 26*a* of coupler carrier 13*a* (FIG. 3) is convexly curved in a transverse direction of the carrier in accordance with a large radius given this top surface. Alternatively, undersurface 19*a* of wear plate 19′ (FIG. 3A) may be convexly curved in a transverse direction in accordance with a given large radius. Curved surface 26*a* therefore supports flat shim 25 and flat wear plate 19 underlying a flat wear plate 43 attached to the underside of the draft bar. The draft bar is therefore permitted to slightly rock about a transverse axis to thereby align itself with a mating coupler on an adjoining car. The wear of wear plate 19 is thereby improved since a more uniform interface pressure between this wear plate and wear plate 43 on the bottom of the draft bar is effected by a curved/flat interface assembly. In the alternative embodiment shown in FIG. 3A, flat upper surface 26 of carrier 13 supports flat shim 25 which underlies wear plate 19′ and is in engagement with curved surface 19*a*. The same type of rocking action is therefore facilitated by the draft bar, as described for FIG. 3, thereby providing a self-aligning feature to improve the wear of the coupler wear plate by providing a more uniform interface pressure with wear plate 43 attached to the bottom of the draft bar (not shown in this Figure).

Striking casting 10, modified as described above, is further modified by lowering the elevation of surface 26 of the coupler carrier relative to a centerline of key slots 14. This dimension, illustrated as $x$ in FIG. 2, is $\frac{1}{4}$ inch greater than a corresponding dimension of an unmodified striking casting. Hence, for a modified striking casting having a dimension $x$ which is $\frac{1}{4}$ inch less than a comparable unmodified striking casting, the center of the face of the coupler knuckle will lie approximately $\frac{3}{4}$ inches lower above the top of the rail. If this decreased coupler height is below the AAR required $32\frac{1}{2}$ inch minimum for empty cars and the $31\frac{1}{2}$ inch minimum for loaded cars, the coupler at the carrier member may be easily raised by inserting a shim or shims 25 of the necessary thickness through access opening 32 to lie beneath the coupler carrier wear plate. The minimum coupler height requirement may accordingly be met without the need for other forms of complicated coupler height adjustments. Of course, if by reason of the reduced dimension $x$, the coupler height at the coupler knuckle is within the required AAR range, no shimming is necessary. It is therefore manifest that car coupler adjustment both up and down is made possible with the present invention.

In view of the foregoing, it can be seen that a simple and economical yet highly effective approach has been taken in adjusting the coupler height of railway cars with the use of a shim which may have a thickness of as little as $\frac{1}{8}$ inch. Thicker shims may be used where necessary or additional shims may be inserted beneath coupler carrier wear plate when coupler height conditions change. The access opening provided in a sidewall of the striking casting is of a minimum dimension consistent with the size of the required shim. The large inner radii at the end walls of the access opening are within the endurance limits of the casting material and the imposed forces to which it is subjected, and the access opening is surrounded with the appropriate reinforcing structure to resist the added bending and torsion that results from such opening in this highly stressed attachment area of the coupler carrier.

The presently designed shim has a central enlarged section which avoids any reduction in bearing surface between the coupler draft bar and the coupler wear plate, and the shim is capable of being locked in place so as to avoid any dislodgement even when used on a rotary car dumper. Provision of this larger desirable support structure, however, creates the risk that the shim could be inserted backwards. However, if the shim is improperly installed, a cotter key or other securing fastener cannot be inserted through the aligned openings since the hole in the shim will be out of alignment by reason of the offsetting of the aligned holes relative to the shim's longitudinal axis. Accordingly, such an arrangement will automatically signal a misapplication to the operator at the time a shim is installed.

A single curved and a single flat surface interface between the coupler carrier and the coupler carrier wear plate is devised so as to facilitate a self-aligning feature which improves the wear of the coupler carrier wear plate as a more uniform interface pressure is created with the wear plate on the bottom of the coupler draft bar.

Obviously, many modifications and variations of the invention are made possible in the light of the above teachings. It is therefore to be understood that within the scope of the appended claims the invention may be practiced otherwise than as specifically described.

What is claimed is:

1. In combination, a striking casting having transversely spaced sidewalls with draft keyways formed therein and a coupler carrier member extending between and connected to said sidewalls, said carrier member having an upper surface for supporting a longitudinally extending coupler, a wear plate extending over said surface and having side flanges embracing said carrier member, and a shim disposed between said surface and said wear plate, the improvement wherein one of said sidewalls has a transversely extending opening through which said shim is adapted to be inserted, said opening being defined by spaced upper and lower walls and concavely curved end walls all extending transversely outwardly of said one sidewall, said upper wall having a predetermined thickness and said lower wall having a thickness greater than said predetermined thickness, whereby a support structure is defined for said opening wherein said end walls function to reduce stress concentration at said opening, said outwardly extending walls defining said opening serve to resist bending stresses of said striking casting, and said lower wall serves to further reduce stress concentration at said opening from torsional and other loads to which said striking casting is subjected.

2. The combination according to claim 1, wherein a portion of said shim lies within said opening when said shim is disposed between said upper surface and said wear plate, said upper and lower walls and said shim portion having axially aligned holes therein offset from a longitudinal centerline of said shim, and a fastener extending through said axially aligned holes for retaining said shim in place, whereby said shim may be retained in place between said upper surface and said wear plate only in one position by reason of said offset aligned holes which will be caused to misalign upon inversion of said shim.

3. The combination according to claim 1, wherein one of said upper surface of said carrier member and a lower surface of said wear plate is convexly curved in transverse cross-section, whereby the coupler may self-align with a mating coupler as said wear plate rocks about its longitudinal axis to thereby insure a uniform interface pressure between said wear plate and the coupler.

4. The combination according to claim 3, wherein said upper surface is convexly curved.

5. The combination according to claim 3, wherein said lower surface is convexly curved.

6. In combination, a striking casting having transversely spaced sidewalls with draft keyways formed therein and a coupler carrier member extending between and connected to said sidewalls, said carrier member having an upper surface for supporting a longitudinally extending coupler draft bar having a yoke in engagement with key slots located in said casting, a wear plate extending over said surface and having side flanges embracing said carrier member, a shim disposed between said upper surface and said wear plate, said carrier member and said wear plate having enlarged center sections extending toward the yoke for enlarging said support surface, the improvement wherein said shim also has an enlarged center section extending toward the yoke, one of said sidewalls having a transversely extending opening through which said shim is adapted to be inserted, said one sidewall having an outwardly extending enlargement defining said opening, a portion of said shim lying within said opening, axially aligned holes being provided in said enlargement and said shim portion and being offset from a longitudinal centerline of said shim, and a fastener extending through said axially aligned holes for retaining said shim in place, whereby said shim may be retained in place between said upper surface and said wear plate only in one position by reason of said offset aligned holes which will become misaligned upon inversion of said shim.

7. The combination according to claim 6, wherein said enlargement is defined by spaced upper and lower walls and concavely curved end walls, said upper wall having a first thickness and said lower wall having a second thickness greater than said first wall, whereby a support structure is defined for said opening wherein said end walls serve to reduce stress concentration at said opening, said enlargement serves to resist bending stresses of said casting, and said lower wall serves to further reduce stress concentration at said opening from torsional and other loads to which said casting is subjected.

8. The combination according to claim 6, wherein one of said upper surface of said carrier member and a lower surface of said wear plate is convexly curved in transverse cross-section, whereby the coupler draft bar may self-align with a mating coupler as said wear plate rocks about its longitudinal axis to thereby insure a uniform interface pressure between said wear plate and the coupler draft bar.

9. The combination according to claim 8, wherein said upper surface is convexly curved.

10. The combination according to claim 8, wherein said lower surface is convexly curved.

* * * * *